US011395554B2

(12) United States Patent
Wolffis

(10) Patent No.: US 11,395,554 B2
(45) Date of Patent: Jul. 26, 2022

(54) SLEEPING BAG SYSTEM WITH RIGID FRAME

(71) Applicant: Wolffis Procurement and Investments LLC, Las Vegas, NV (US)

(72) Inventor: Brian Claude Wolffis, Las Vegas, NV (US)

(73) Assignee: Wolffis Procurement and Investments LLC, Las Vegas, NV (US)

( * ) Notice: Subject to any disclaimer, the term of this patent is extended or adjusted under 35 U.S.C. 154(b) by 0 days.

(21) Appl. No.: 17/497,374

(22) Filed: Oct. 8, 2021

(65) Prior Publication Data

US 2022/0110463 A1 Apr. 14, 2022

Related U.S. Application Data

(60) Provisional application No. 63/091,044, filed on Oct. 13, 2020.

(51) Int. Cl.
*A47G 9/08* (2006.01)
*A47G 9/00* (2006.01)

(52) U.S. Cl.
CPC ..... *A47G 9/086* (2013.01); *A47G 9/08* (2013.01)

(58) Field of Classification Search
CPC ..... A47G 9/086; A47G 9/08; A47G 9/083
USPC ..... 5/413 R, 413 AM
See application file for complete search history.

(56) References Cited

U.S. PATENT DOCUMENTS 1,267,551 A * 5/1918 Jacobs ..... A47G 9/08 5/413 R
1,964,271 A * 6/1934 O'Dwyer ..... A47G 9/083 128/873
2,073,979 A * 3/1937 Wallin ..... A61G 1/01 5/413 R
2,284,900 A * 6/1942 Henderson et al. ..... A45F 3/22 5/122
2,854,948 A * 10/1958 Drayson ..... A01K 1/0353 119/482
3,565,040 A * 2/1971 Pohl ..... A01K 1/0353 119/28.5
3,751,741 A * 8/1973 Hendry ..... A47G 9/086 5/413 AM
3,842,454 A * 10/1974 Young ..... A47G 9/086 5/413 R
4,012,800 A * 3/1977 Mitchell ..... A23B 7/148 5/187
4,125,909 A * 11/1978 Jacobson ..... A45F 3/22 5/121
5,548,858 A * 8/1996 Shoa ..... A47G 9/08 5/413 R
6,035,466 A * 3/2000 Homeyer ..... A47D 7/002 5/93.1
6,185,762 B1 * 2/2001 Homeyer ..... A47D 7/002 5/93.1

(Continued)

FOREIGN PATENT DOCUMENTS

GB 2267820 A * 12/1993 ..... A47G 9/086

*Primary Examiner* — Robert G Santos
(74) *Attorney, Agent, or Firm* — K&L Gates LLP

(57) ABSTRACT

A sleeping bag body includes one or more sleeves along a perimeter of the sleeping bag body and a plurality of poles that interconnect to form a frame. The frame is positioned within the one or more sleeves of the bag body to prevent a twisting movement of the bag body during use.

14 Claims, 10 Drawing Sheets

(56) References Cited

U.S. PATENT DOCUMENTS

| | | | | |
|---|---|---|---|---|
| 6,243,892 | B1 * | 6/2001 | Kelling | A45F 4/06 224/153 |
| 6,631,528 | B2 * | 10/2003 | Landry | A47D 15/008 128/872 |
| 6,681,422 | B2 * | 1/2004 | Landry | A47D 15/008 128/872 |
| 6,848,131 | B1 * | 2/2005 | Landry | A47D 15/008 5/494 |
| 6,857,146 | B2 * | 2/2005 | Landry | A47D 15/008 128/872 |
| 7,370,377 | B2 * | 5/2008 | Landry | A47D 15/02 5/494 |
| 8,020,226 | B2 * | 9/2011 | Landry | A47D 15/008 5/494 |
| 2003/0154548 | A1 * | 8/2003 | Landry | A47G 9/02 5/494 |
| 2003/0154549 | A1 * | 8/2003 | Landry | A47D 15/008 5/494 |
| 2004/0019970 | A1 * | 2/2004 | Landry | A47D 15/02 5/494 |
| 2004/0199999 | A1 * | 10/2004 | Landry | A47D 15/02 5/494 |
| 2005/0028278 | A1 * | 2/2005 | Landry | A47D 15/008 5/494 |
| 2010/0242173 | A1 * | 9/2010 | Landry | A47D 15/02 5/494 |

* cited by examiner

SLEEPING BAG SYSTEM WITH RIGID FRAME

CROSS-REFERENCE TO RELATED APPLICATIONS

This application claims the benefit of U.S. Provisional Application No. 63/091,044 filed Oct. 13, 2020, the entire disclosure of which is hereby incorporated by reference herein.

BACKGROUND OF THE INVENTION

The present subject matter relates generally to a sleeping bag. Specifically, the present subject matter provides a sleeping bag with a rigid frame and a method of use of the same.

Sleeping bags are a necessary item for some outdoor recreation activities such as overnight camping. A sleeping bag is traditionally an insulated covering having a rectangular shape and sized for a person. People often use sleeping bags when going on multi-day outdoor adventures such as overnight hunting, camping, and hiking trips. Kids also use sleeping bags when sleeping over at a friend's house. A sleeping bag must be compact enough to be carried by the user along with other belongings when traveling and/or throughout the course of outdoor activities. A sleeping bag must also be light enough so as to not over burden the user during lengthy excursions.

One common problem presented by standard sleeping bags is that a typical sleeping bag twists and turns as the sleeping person moves during sleep. In particular, when a user turns while sleeping, the sleeping bag may twist and wind around the user, leaving the user awkwardly entwined in the sleeping bag. This restriction prevents the user from stretching out completely, resulting in an uncomfortable sleep. This awkward entwinement also interferes with the user's ability to easily climb out of the sleeping bag in the instance of an emergency. For example, a child waking in the middle of the night needing to go to the bathroom often has difficulty getting out of the sleeping bag quickly enough to use the restroom. Whether the child is sleeping in a tent in the woods or at a friend's house, the inability to get out of the bag can lead to an embarrassing accident. Moreover, the twisting of the sleeping bag may result in overheating of the user which could lead to dangerous health conditions while in the outdoors, such as dehydration, for instance.

Accordingly, there exists a need for a sleeping bag assembly that allows a user to move freely during sleep without risking entanglement, as described herein.

BRIEF SUMMARY OF THE INVENTION

The present disclosure provides a sleeping bag system including a sleeping bag body with one or more sleeves along a perimeter thereof within which a rigid frame is positioned. The sleeping bag system includes a plurality of poles that interconnect to form the rigid frame. The frame can be assembled and disassembled easily for transporting. During use, the rigid frame maintains the sleeping bag in a taut position as the user sleeps, enabling the user to twist and turn while sleeping without getting tangled within the sleeping bag. The user can easily and quickly get out of the sleeping bag, for example, if the user needs to use the bathroom or if an animal is approaching the tent. The sleeping bag system is also compact and lightweight, allowing the user to easily carry the system while hiking and camping.

The sleeping bag body may be any type of sleeping bag. For example, the sleeping bag body could be a standard rectangular sleeping bag, a mummy shaped sleeping bag, a sleeping bag for two people, a child sized sleeping bag, or the like.

The one or more sleeves may be secured to an outer surface of the bottom layer of the sleeping bag body adjacent to the edges thereof. In some embodiments, the one or more sleeves may be secured to an underside of the sleeping bag body so that the sleeves are hidden from view during use. In another example, the sleeves may attaches to the outermost surfaces of each edge such that the sleeve extends outwardly away from the sleeping bag body when the frame is positioned within the sleeves.

In the embodiment illustrated herein, each sleeve is a rectangular fabric folded along a centerline so that the side edges are aligned together, forming a tunnel opposite of the side edges. The bottom surface of the sleeping bag body includes a cut line spaced from the side edges thereof through which the aligned side edges of the sleeve are positioned. The aligned side edges are secured to an inner surface of the bottom layer of the sleeping bag body as part of an inner portion of the sleeve. The sleeve extends through the cut line so that the tunnel is positioned along an outer surface of the bottom layer, forming the outer portion of the sleeve.

The sleeve may be secured to the bottom layer through one or more lines of stitching. In one embodiment, the inner portion of the sleeve is stitched to the sleeping bag body along two spaced lines spanning a width of the inner portion, and the outer portion of the sleeve is stitched to the sleeping bag body adjacent to the cut line, allowing the tunnel to be open for receiving the frame poles. In another embodiment, the sleeves attach to the sleeping bag body through a zip fastener. Other means for attaching the sleeves to the sleeping bag body may also be used as needed or desired.

The plurality of frame poles that are assembled to form the rigid frame. Each pole may be tubular, including a cylindrical side wall with first and second opposing open ends. In one embodiment, the plurality of poles may include poles corresponding to the length of each side of the sleeping bag body. For example, the plurality of poles may include first and second long poles that are positioned along the first and second side edges, respectively, of the sleeping bag body. Ninety degree connectors may be used to connect adjacent poles at the corners.

In another embodiment, the plurality of poles may include individual poles, a set of 90 degree connectors, and a set of linear connectors. Three individual poles may be connected through two linear connectors to form a longer interconnected pole with a length corresponding to a side edge of the sleeping bag body. In some embodiments, an elastic cord may be positioned within the poles forming the interconnected pole to urge the poles into the linear configuration. The rigid frame may be formed with two interconnected poles and two end poles, connected together through the 90 degree connectors. Use of a plurality of shorter individual poles enables the poles to be disassembled into a transportable stack of poles for packing and/or carrying.

While the first and second side poles extend the sleeping bag to its full length, the first and second end poles extend the sleeping bag to its full width. In this way, the poles, while connected, provide a rigid frame for the sleeping bag. In one embodiment, each pole or set of poles is threaded through the respective sleeve of each edge of the sleeping bag body and connected in the corners by a connector, such as a 90 degree elbow.

In some embodiments, one or more connectors are secured within the sleeves for receiving poles. For example, first and second 90 degree connectors or other suitable structures are positioned and secured within first and second corners where an end edge sleeve joins opposing side edge sleeves. During use, the user may position a first end of the end pole in the first 90 degree connector and then position the second end of the end pole in the second 90 degree connector. The distance between the first and second connectors dimensioned to tightly and snugly fit the end pole in place.

The sleeping bag may comprise four corner tie-downs to enable the sleeping bag to be tied to, for example, a portable cot. In another example, the sleeping bag in the expanded position may be tied to a wall of a tent, opening up floor space within the tent when the sleeping bag is not needed.

The sleeping bag may have a highly visible hunter orange waterproof flexible vinyl outer shell. The sleeping bag may include an inside shell comprised of polyester fiber batting. The sleeping bag may contain a detachable GPS locator.

An aspect of the present invention is a method of providing

An objective of the present invention is to hold a sleeping bag taut in order to ensure that a user does not become tangled within a sleeping bag during sleep.

An advantage of the present system is providing a rigid sleeping bag that will not twist around a user. For example, the sleeping bag will allow a user to move freely without twisting the sleeping bag.

A further advantage of the present system is providing a compact and light weight sleeping bag that is easy to transport and convenient to store.

Another advantage of the present system is providing a sleeping bag that may be easily spotted for recovery.

Additional objects, advantages, and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations.

DETAILED DESCRIPTION OF THE INVENTION

Figure 1:
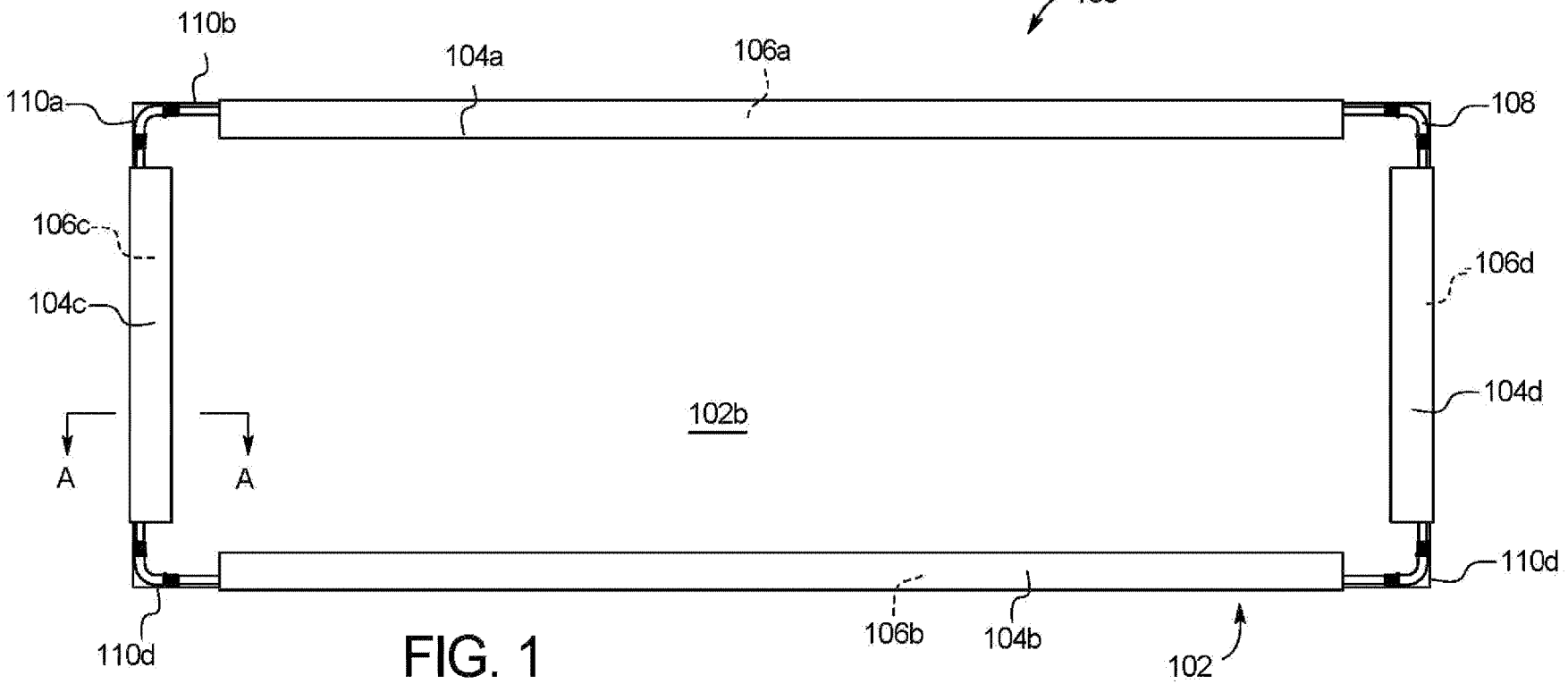
FIG. 1 is a bottom plan view of a sleeping bag system according to the present disclosure.
Figure 2:
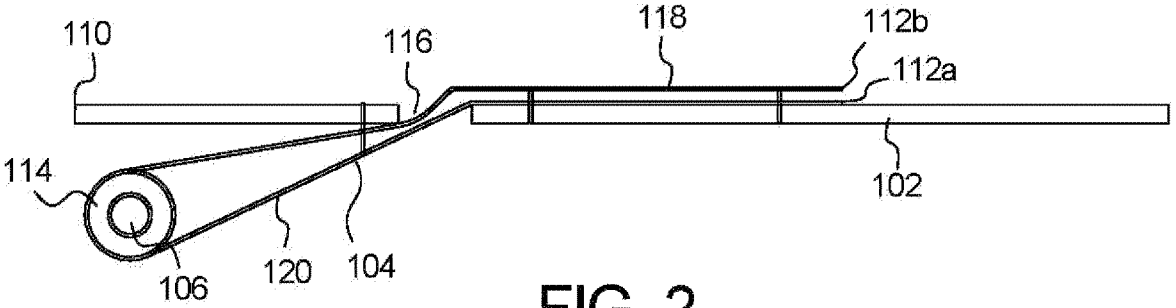
FIG. 2 is a cross-sectional view of the sleeping bag system of FIG. 1 taken generally along lines A-A of FIG. 1.
Figure 3:
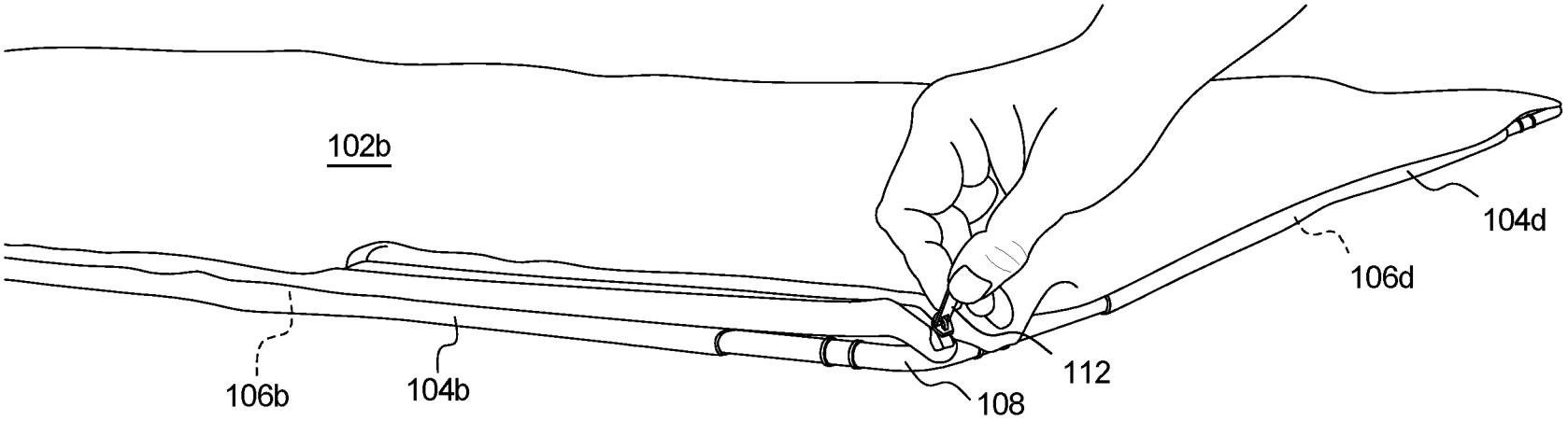
FIG. 3 is a perspective view of an end of the sleeping bag system of FIG. 1.

FIGS. 1-5 illustrate an example sleeping bag system 100 of the present application. The sleeping bag system 100 includes a sleeping bag body 102 with one or more outer sleeves 104 configured to receive a plurality of frame poles 106. The frame poles 106 are assembled together during use to form a rigid frame 108. As shown in FIGS. 1-3, the rigid frame 108 maintains the positioning of the sleeping bag body 102 in a relatively flat, extended position.

The sleeping bag body 102 of the sleeping bag system 100 may be any type of sleeping bag. For example, the sleeping bag body 102 may include a rectangular planar fabric or quilted layers of fabric folded along a centerline with a zip fastener along a first end edge 110*a* and one of the side edges 110*b*, 110*d*. The zippered side edge is opposite the folded centerline of the rectangular fabric, and a second end edge 110*c* of the folded material remains open for the user's head. In the zipped configuration, the sleeping bag body 102 has a longitudinal shape in which the user's body is positioned. As shown in the embodiment illustrated in FIGS. 1 and 7, the sleeping bag body 102 includes an upper surface 102*a* (see FIG. 7) and a lower surface 102*b* (see FIG. 1) opposite the upper surface 102*a*. In some embodiments, the side edge comprising the folded centerline of the fabric may also include a zippered portion of about 12 to 18 inches in length adjacent to the second end edge 110*c* so that the user can fold an end of the upper layer down during use.

In another embodiment, the sleeping bag body 102 may taper in width from the second end toward the first end such that the open second end 110*d* is wider than the zippered first end 110*a*. In this embodiment, the sleeping bag body 102 has a shape that more closely approximates the user's body shape. In still further embodiments, the sleeping bag body 102 may be sized for two people, having a width approximately 1.5 to 2 times the width of a standard sleeping bag. The sleeping bag system may also use sleeping bag bodies having other shapes and sizes as needed or desired.

Referring to FIGS. 1 and 3, the bottom layer 102*b* of the sleeping bag body 102 includes one or more outer sleeves 104 positioned along the perimeter thereof. First through fourth sleeves 104*a*-104*d* are positioned along the first end edge 110*a*, the first side edge 110*b*, the second end edge 110*c*, and the second end edge 110*d*, respectively. In the illustrated embodiment, each sleeve 104 extends along a majority of the associated edge 110. In another embodiment, each side edge 110 includes two or more spaced sleeves in lieu of a singular sleeve extending along the full edge. In other embodiments, each sleeve 104 may comprise a plurality of tabs spaced along the associated edge.

In the example embodiment, each sleeve 104 comprises a rectangular fabric folded along a centerline so that the side edges 112*a*, 112*b* are aligned together, forming a tunnel 114 opposite of the side edges 112*a*, 112*b*.

As shown in FIG. 2, the bottom surface 102*a* of the sleeping bag body 102 includes a cut line 116 spaced from the side edges 110 thereof through which the aligned side edges 112*a*, 112*b* of the sleeve 104 are positioned. The aligned side edges 112*a*, 112*b* are secured to an inner surface of the bottom layer 102*a* of the sleeping bag body 102 as part of an inner portion 118 of the sleeve 104. The sleeve 104 extends through the cut line 116 so that the tunnel 114 is positioned along an outer surface of the bottom layer 102*a*, forming the outer portion 120 of the sleeve 104.

The sleeve 104 may have an overall width of between about two and five inches, with the outer portion 120 having a width of between two to three inches, and a length corresponding to the associated side edge 110 of the sleeping bag body 102. For example, the sleeping bag body 102 has a length of approximately 73 inches and a width of approximately 32 inches. Sleeves 104*b*, 104*d* are attached to the first and second side edges 110*b*, 110*d* of the sleeping bag body 102, and sleeves 104*a*, 104*c* are attached to the first and second end edges 110*a*, 110*c* of the sleeping bag body 102.

The sleeve 104 may be secured to the bottom layer 102*a* through one or more lines of stitching 122. In one embodiment, the inner portion 118 of the sleeve 104 is stitched to the sleeping bag body 102 along two spaced lines 122*a*, 12*b* spanning a width of the inner portion 118, and the outer portion 120 of the sleeve 104 is stitched to the sleeping bag body 102 adjacent to the cut line 116, allowing the tunnel 114 to be open for receiving the frame poles 106.

In another embodiment, the sleeves 104 attach to the sleeping bag body 102 through a zip fastener. For example, a first row of zipper teeth is sewn to the outer surface of the bottom layer of the sleeping bag body along each side edge. A corresponding second row of zipper teeth is secured along the length of the sleeve 104. Other means for attaching the sleeves 104 to the sleeping bag body 102 may also be used as needed or desired.

The rectangular planar quilted layers of the sleeping bag body 102 and the sleeves 104 may be made of fabrics such as nylon, polyester, taffeta, polycotton, flannel, DryLoft®, ripstop, or any other suitable material. The sleeping bag body 100 may include one or more zip fasteners along one or more side edges 110 thereof.

Figure 4:
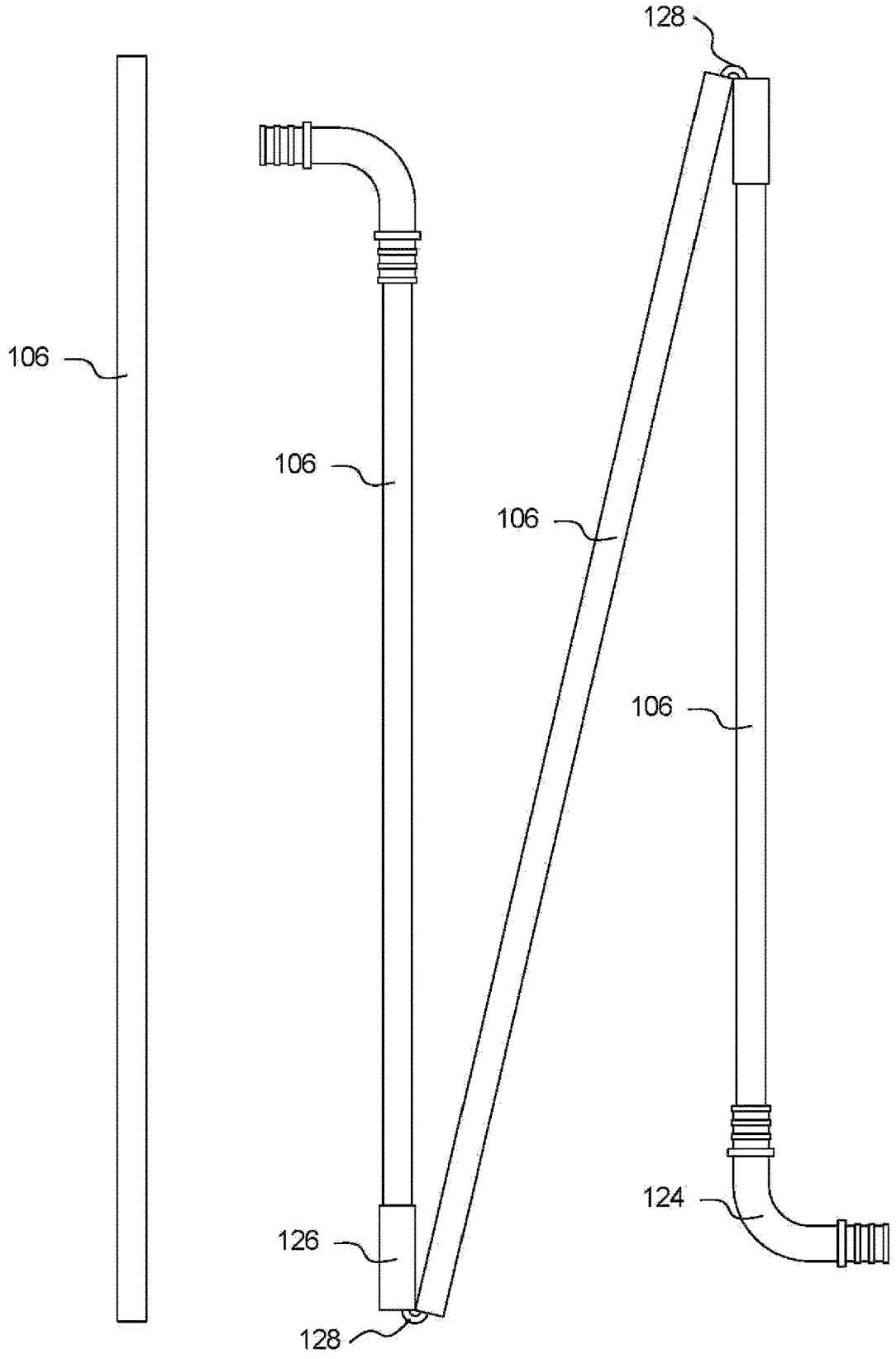
FIG. 4 is a plan view of frame poles of the sleeping bag system of FIG. 1.
Figure 5:
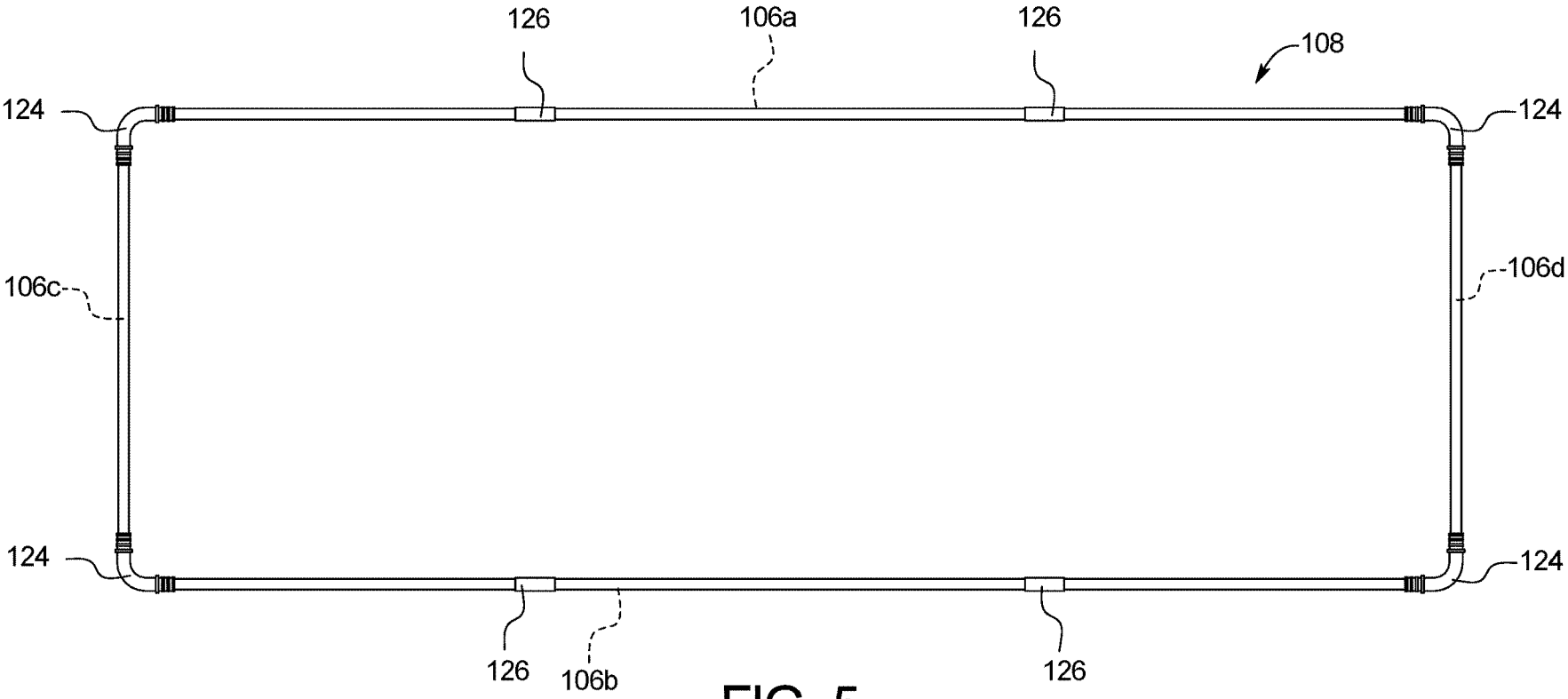
FIG. 5 is an example frame of the sleeping bag system formed from the frame poles of FIG. 4.

Referring to FIGS. 4 and 5, the sleeping bag system 100 also includes a plurality of frame poles 106 that are assembled to form the rigid frame 108. In the illustrated embodiment, each pole 106 is tubular, including a cylindrical side wall with first and second opposing open ends. Each frame pole 106 may be any suitable diameter. For example, each pole 106 may be tubular fiberglass with a ⅜-in outer diameter. The frame poles 106 are made of a lightweight and structurally sound material such as fiberglass, plastic, aluminum, or any other suitable material that is weather resistant and durable.

In one embodiment, the plurality of poles 106 may include poles corresponding to the length of each side of the sleeping bag body 102. For example, the plurality of poles 106 may include first and second long poles 106 that are positioned along the first and second side edges 110, respectively, of the sleeping bag body 102. Ninety degree connectors 124 may be used to connect adjacent poles 106 at the corners, as shown in FIGS. 1 and 5.

In another embodiment, the plurality of poles 106 may include individual poles, a set of 90 degree connectors 124, and a set of linear connectors 126. Three individual poles 106 may be connected through two linear connectors 126 to form a longer interconnected pole with a length corresponding to a side edge 110 of the sleeping bag body 102.

In some embodiments, an elastic or bungee cord 128 may be positioned within the poles 106 forming the interconnected pole. The length of the elastic cord 128 is slightly less than the length of the interconnected poles 106 so that the elastic force urges the poles 106 into the linear configuration. The rigid frame 108 may be formed with two interconnected poles 106 and two end poles 106, connected together through the 90 degree connectors 124 as shown in FIGS. 1 and 5. Use of a plurality of shorter individual poles 106 enables the poles 106 to be disassembled into a transportable stack of poles for packing and/or carrying.

Each connector has an inner diameter sized to receive an end of a pole of the plurality of poles. A connector connects adjacent poles when the plurality of poles are interconnected to form the frame. The 90 degree connectors 124 and the linear connectors 126 may be made of copper or any other suitable or compatible material configured to withstand wear and tear from use.

In some embodiments, each the 90 degree connector 124 is permanently secured to the ends of the first and second long poles 106 or subset of shorter poles forming each long pole 106. In other embodiments, the 90 degree connectors are removably secured to the poles 106 so that the connectors 124, 126 can be attached or removed as needed to easily construct the rigid frame 108.

In another embodiment, the ends of the poles are dimension to mate together. Each pole of the plurality of poles has a tubular shape including a first end and a second end, and an inner diameter of the second end is sized to receive an outer diameter of the first end such that the plurality of poles are configured to press fit together to form the frame. Connectors may optionally be used for reinforcement.

During use, the user lays the sleeping bag body 102 flat on the ground with the bottom layer 102*b* facing up. The user positions the pole 106 of the correct length into the appropriate sleeve 104 of the side edge 110 of the sleeping bag body 102 having the same length. If needed, the user connects poles 106 using linear connectors 126 to form a singular long pole for the side edges 110*b*, 110*d*. The user then uses 90 degree connectors 124 to secure adjacent poles 106 together and form the rigid frame 108.

When the user is ready to roll up the sleeping bag system 100, the user first disconnects the poles 106 from one another at the connectors 124, 126. The user may place the poles 106 and connectors 124, 126 into a carrier bag, and positions the poles 106 and carrier bag at an end side edge 110*a*, 110*c* of the sleeping bag body 102. The user then rolls the poles 106 up with the sleeping bag body 102 and held together in the rolled configuration using one or more elastic bands, cords, or any other suitable retention means.

Figure 6:
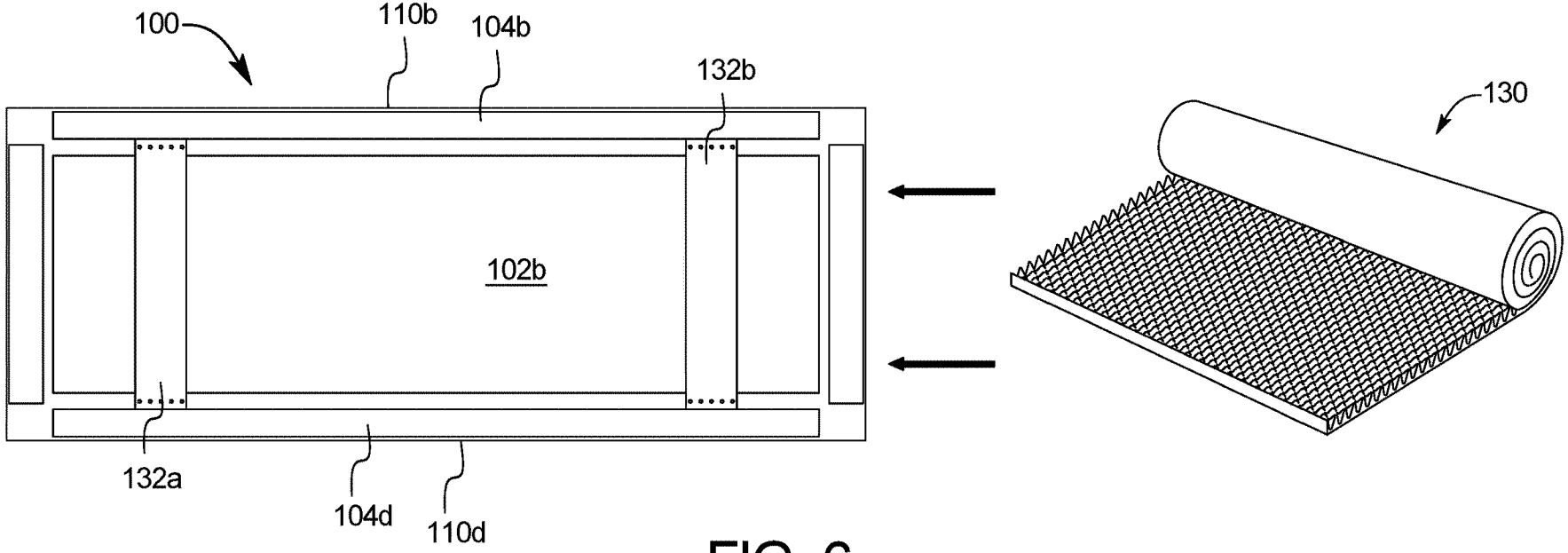
FIG. 6 is a bottom plan view of another embodiment of the sleeping bag system of FIG. 1.

In a further embodiment illustrated in FIG. 6, the sleeping bag system also includes a sleeping bag cushion 130 that can be positioned within the fabric layering of or against the sleeping bag body 102. For example, the sleeping bag body 102 may include first and second straps 132*a*, 132*b* spanning the width of the outer surface of the bottom layer 102*a* between the sleeves 104*b*, 104*d* along the side edges 110*b*, 110*d*. In other embodiments, the first and second straps may span the length of the outer surface of the bottom layer 102*a*. In still further embodiments, the sleeping bag system 100 may include the first and second straps spanning opposite edges of the sleeping bag body 102 without the use of sleeves 104 and poles 106.

In one embodiment, the cushion has a shape that is similar to the shape of the sleeping bag body 102. The cushion 130, such as an egg crate sleeping bag cushion or a thin air mattress, may positioned under the sleeping bag body 102 and snugly fit between the straps 132*a*, 132*b* and the bottom layer 102*a* of the sleeping bag body 102. The straps 132*a*, 132*b* may comprise an elastic or a non-elastic material.

Alternatively, the sleeping bag body 102 may include a slot or zippered opening along one of the end or side edges 110*a*-110*d* for receiving the egg crate sleeping bag cushion or thin air mattress 130. The egg crate cushion 130 may be rolled up with the sleeping bag body 102 for easy transport. The sleeping bag body 102 may also be provided with an additional blanket or quilt that can be attached to the body 102 along the side edges 110*b*, 110*d* thereof through a hook and loop fastener, fabric ties, or other means of attaching. The additional blanket may also be rolled up and used as a pillow.

Figure 7:
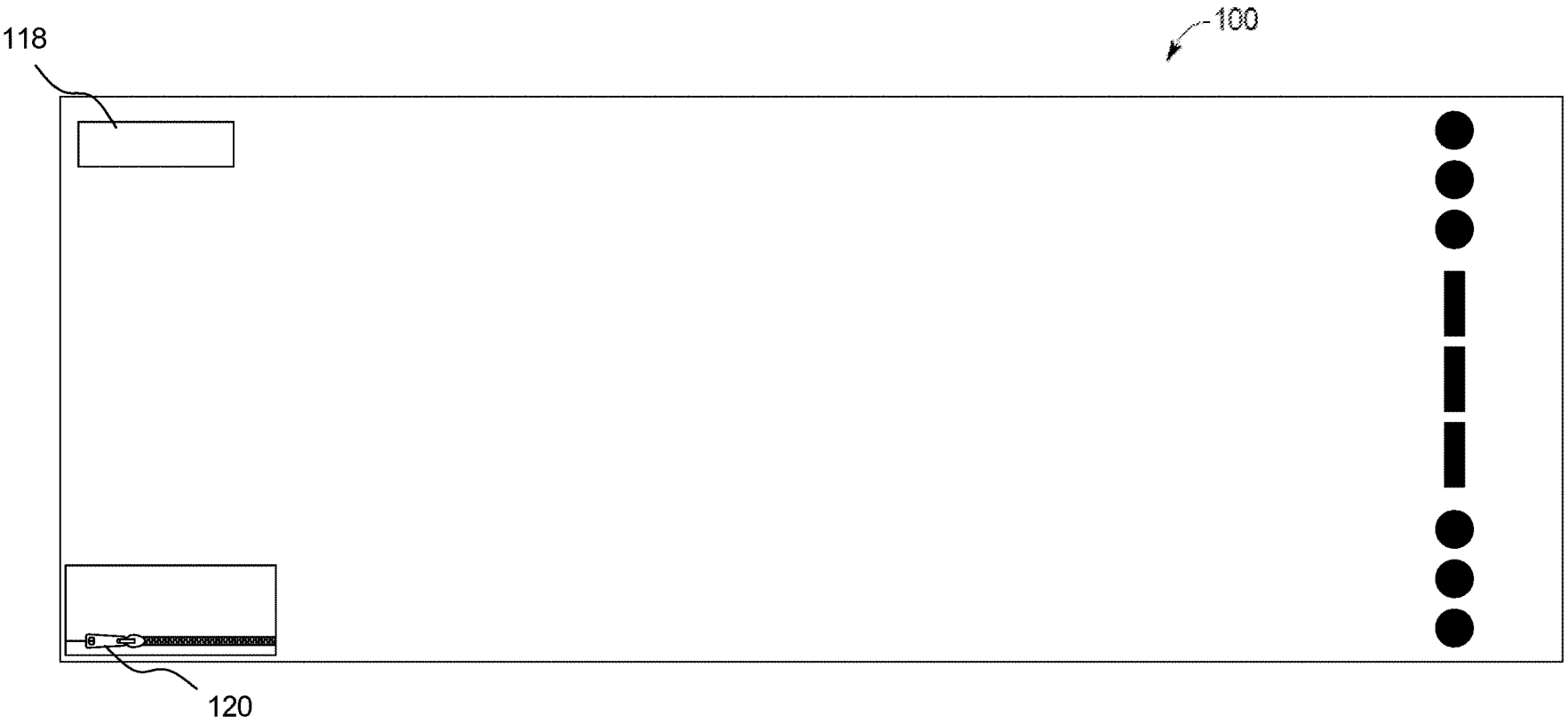
FIG. 7 is a plan view of the sleeping bag system of FIG. 1.

Referring to FIG. 7, the sleeping bag body 102 may include one or more pouches or ditty bags 118, 120 secured to the outer surface of the upper layer 102*a* or within the sleeping bag body 102 on the inner surfaces of the upper or bottom layers 102*a*, 102*b*. The pouches 118 and/or zippered ditty bag 120 may be used to hold valuables such as rings, cell phones, and other small items. In this example, a user can hold valuables in a protected spot of the sleeping bag system 100.

In an embodiment, the sleeping bag 100 may comprise a plastic sheet rolled up with the sleeping bag body 102 for storage. In such an embodiment, the plastic sheet may be used as a vapor barrier between the sleeping bag system 100 and the ground. The plastic sheet is made of polystyrene in some instances. The plastic sheet may be, for example, 30 millimeters thick. The plastic sheet may be the color hunter orange. However, other embodiments are envisioned wherein the plastic sheet may be camouflage.

Figure 8:
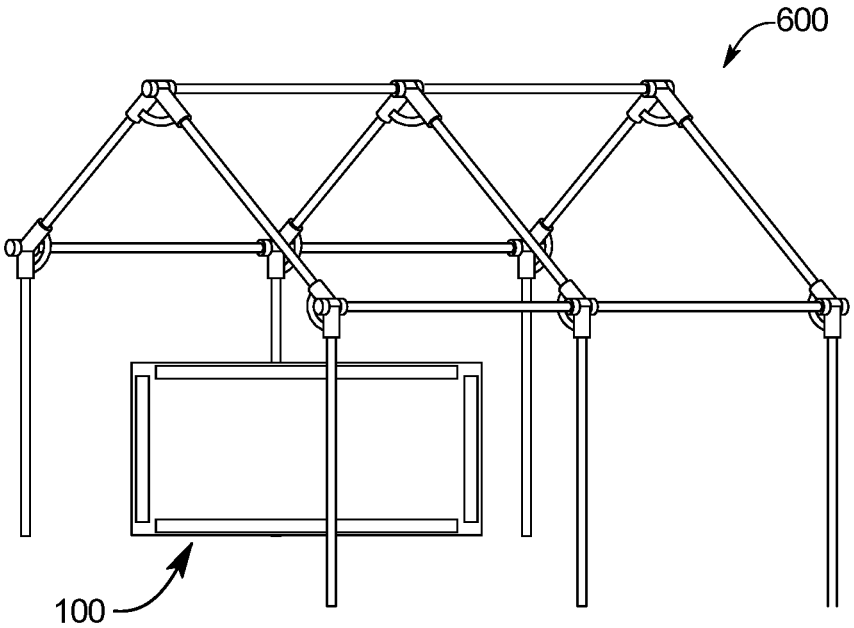
FIG. 8 illustrates the use of the sleeping bag system of FIG. 1 within a tent.
Figure 8:
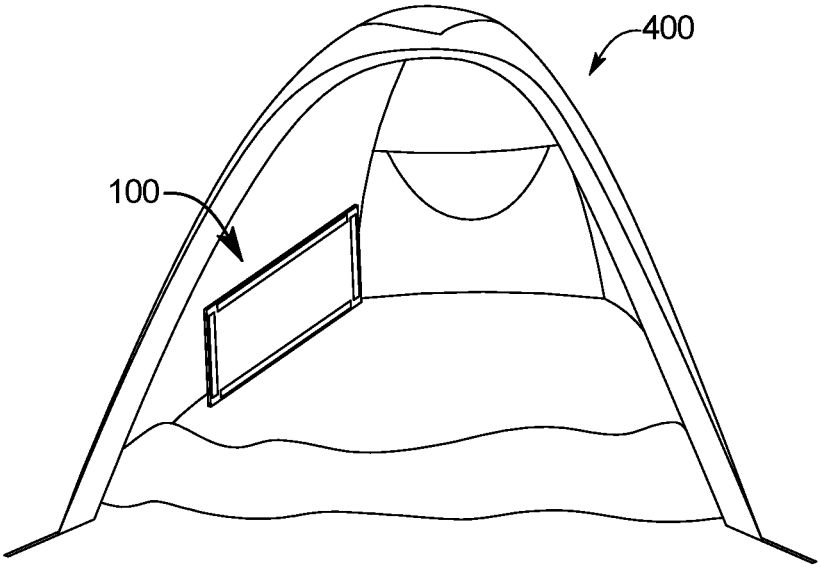

Referring to FIG. 8, the sleeping bag system 100 may include corner tie-downs to enable the sleeping bag body to be tied to horizontal or vertical surfaces. For example, the tie-downs enable the user to secure the sleeping bag system to a portable cot or a wall of a tent 400 or tent structure 600. In this way, floor space within the tent 400 or the tent structure 600 may be available for use when the sleeping bag 100 is not needed.

Figure 9A:
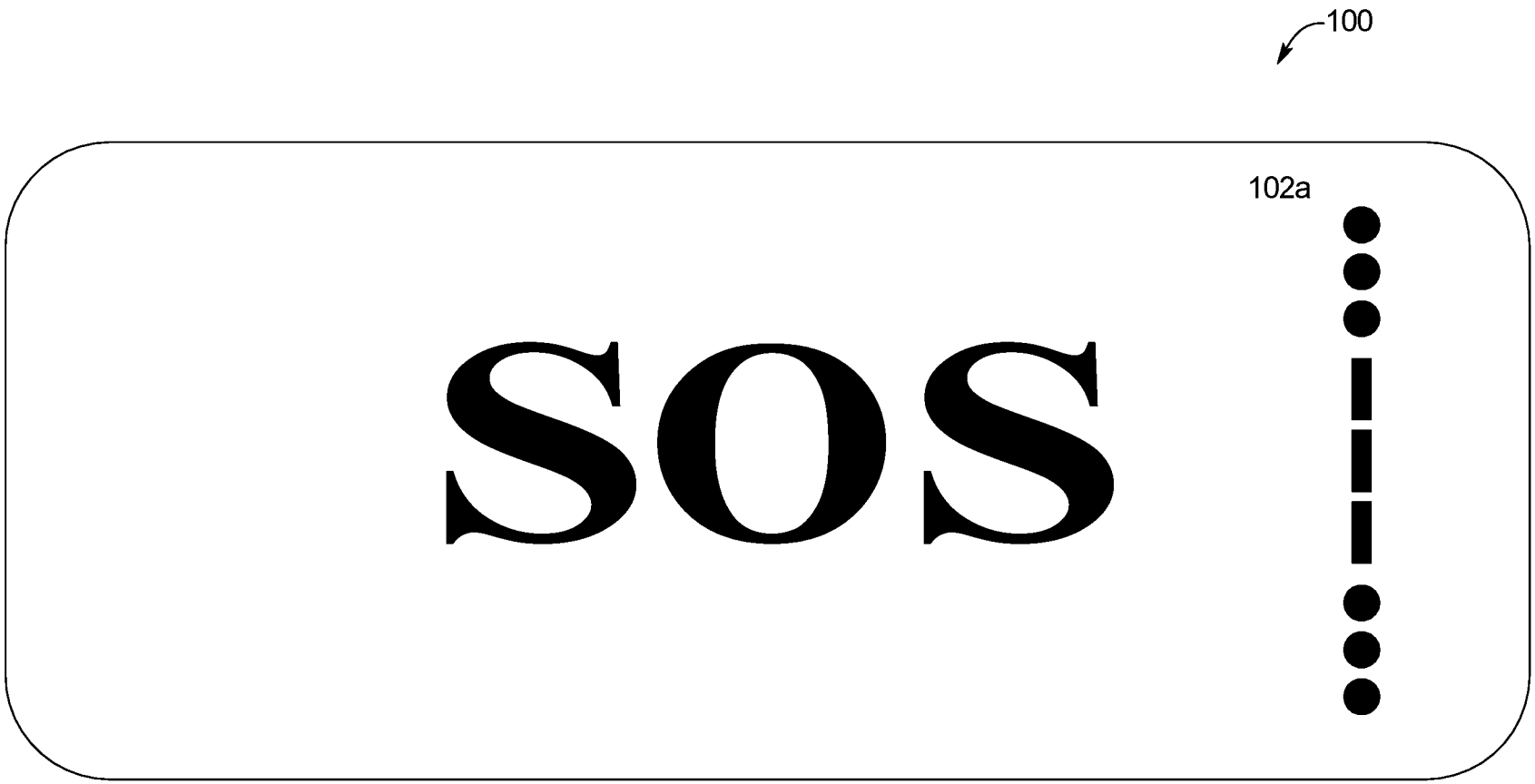
FIGS. 9A and 9B are a plan view and an aerial view of the sleeping bag of FIG. 1 demonstrating optional lettering used in emergencies.
Figure 9B:
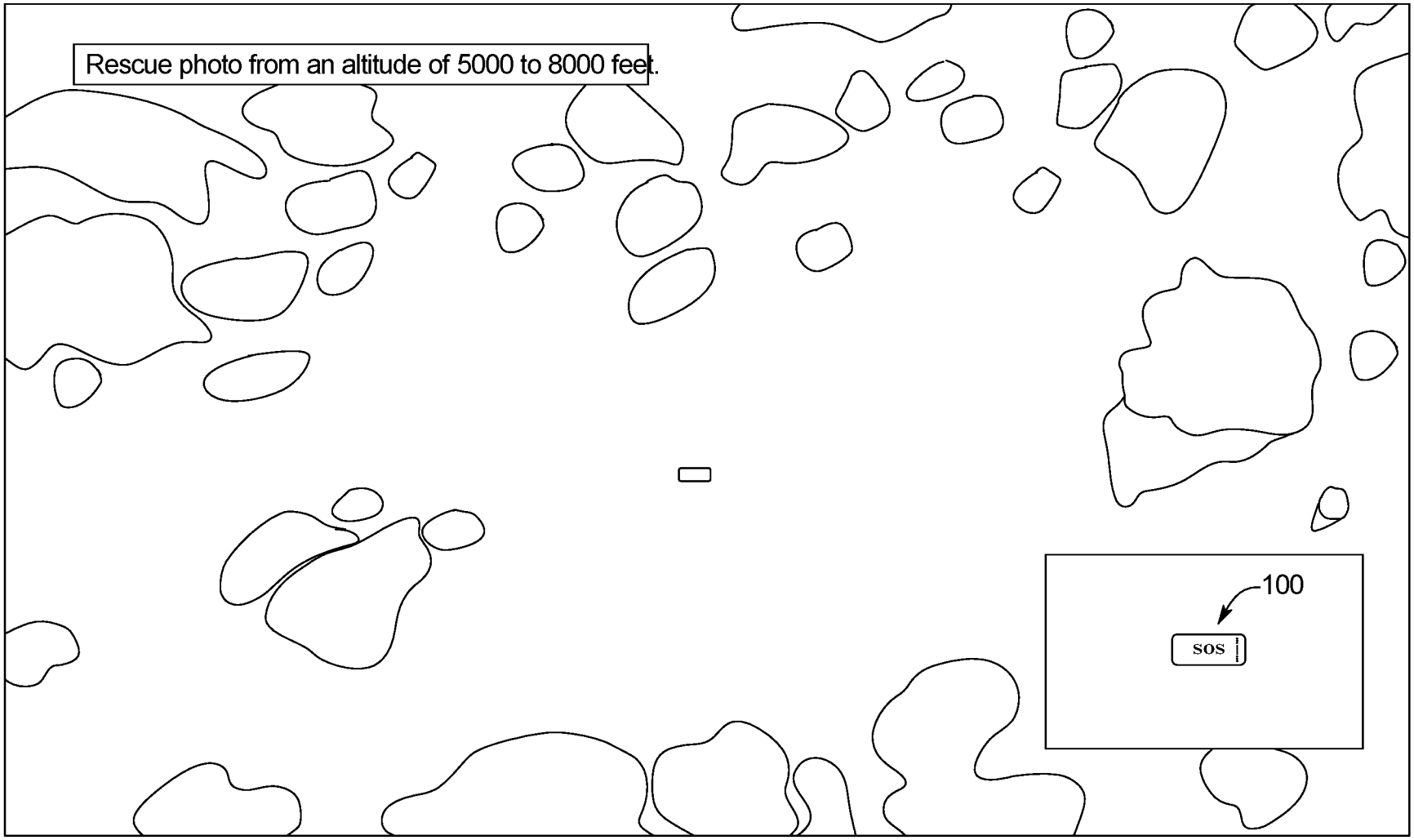

In some embodiments, the sleeping bag system may also be used as a communication means in an emergency situation. For example, the sleeping bag body may include the letters "SOS" in bold black print or Morse code as shown in FIG. 9A. In some embodiments, the sleeping bag system 100 may have a high visible waterproof flexible vinyl outer shell. In such an embodiment, the sleeping bag may be easily spotted for aerial or land based recover as seen in FIG. 9B.

Figure 10:
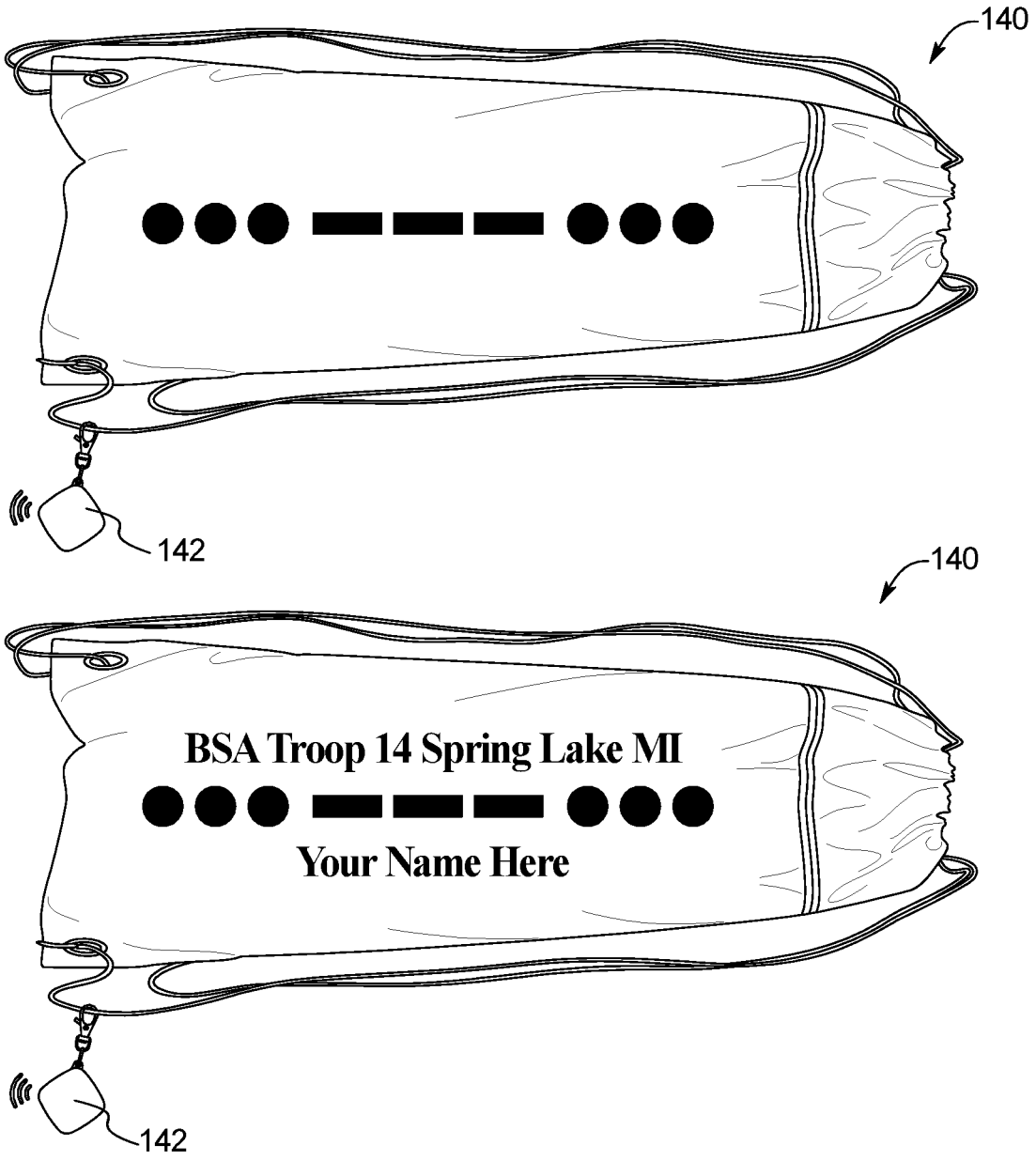
FIG. 10 illustrates carrier bags for use with the sleeping bag system of FIG. 1.

Referring to FIG. 10, the sleeping bag system 100 may also include a carrier bag 140 with optional customized lettering. In a further embodiment, the sleeping bag system 100 may contain a detachable GPS locator 142. In an embodiment, the sleeping bag system 100 may contain a GPS locator 142 sewed into the sleeping bag 100 so that a user does not need to worry about misplacing or carrying the GPS locator. In an embodiment, one or more of the poles may contain the GPS locator.

An aspect of the present invention is a method of providing a rigid sleeping bag 100. The method includes inserting a tubular frame into the sleeping bag 100. More specifically the method comprises: provide a sleeping bag with sleeves, place poles in sleeve, connect the poles using 90 degree elbows. Using the method described above, a sleeping bag 100 with a rigid frame which will not easily twist around a user is obtained.

It should be noted that various changes and modifications to the presently preferred embodiments described herein will be apparent to those skilled in the art. Such changes and modifications may be made without departing from the spirit and scope of the present invention and without diminishing its attendant advantages.

What is claimed is:

1. A sleeping bag system comprising:

a sleeping bag body including an upper layer and a bottom layer opposite the upper layer, the sleeping bag body including one or more sleeves along a perimeter of the sleeping bag body; and a plurality of poles that interconnect to form a frame;

wherein the frame is positioned within the one or more sleeves of the sleeping bag body and configured to prevent a twisting movement of the sleeping bag body during use;

wherein each sleeve of the one or more sleeves comprises a rectangular sleeve panel including first and second side edges, wherein the first and second side edges are aligned to form a tunnel, wherein the aligned first and second side edges of each sleeve are attached to the sleeping bag body, wherein the sleeping bag body includes one or more cut lines, and wherein each sleeve of the one or more sleeves extends through each cut line of the one or more cut lines within of the sleeping bag body.

2. The sleeping bag system of claim 1, wherein the one or more sleeves includes first, second, and third sleeves secured to first, second, and third edges, respectively, on the bottom layer of the sleeping bag body, and wherein the frame extends through the first, second, and third sleeves.

3. The sleeping bag system of claim 2, wherein the one or more sleeves includes a fourth sleeve secured to a fourth edge of the bottom layer of the sleeping bag body, and wherein the frame extends through the first, second, third and fourth sleeves.

4. The sleeping bag system of claim 1, wherein each cut line of the one or more cut lines is provided on the bottom layer of the sleeping bag body, and wherein each sleeve includes an inner portion positioned above an inner surface of the bottom layer and an outer portion positioned below an outer surface of the bottom layer.

5. The sleeping bag system of claim 1, further comprising one or more connectors, each connector configured to connect adjacent poles of the plurality of poles forming the frame.

6. The sleeping bag system of claim 5, wherein each connector has an inner diameter sized to receive an end of a pole of the plurality of poles.

7. The sleeping bag system of claim 5, wherein the one or more connectors includes a 90 degree connector.

8. The sleeping bag system of claim 1, further comprising one or more elastic cords, wherein each pole of the plurality of poles has a tubular shape, wherein each of the one or more elastic cords extends through a subset of the plurality of poles.

9. The sleeping bag system of claim 1, wherein the sleeping bag body further comprises at least one storage compartment.

10. The sleeping bag system of claim 1, wherein the sleeping bag body further comprises safety features selected from the group consisting of lettering and a high visible outer shell.

11. A sleeping bag system comprising:

a sleeping bag body including first and second side edges and first and second end edges, the sleeping bag body including one or more straps spanning one of the first and second side edges or the first and second end edges the sleeping bag body including one or more sleeves along a perimeter of the sleeping bag body; and a cushion having a shape similar to the sleeping bag body, wherein the cushion is positioned between the sleeping bag body and the one or more straps and is configured to prevent a twisting movement of the sleeping bag body during use;

wherein each sleeve of the one or more sleeves comprises a rectangular sleeve panel including first and second side edges, wherein the first and second side edges are aligned to form a tunnel, wherein the aligned first and second side edges of each sleeve are attached to the sleeping bag body, wherein the sleeping bag body includes one or more cut lines, and wherein each sleeve of the one or more sleeves extends through each cut line of the one or more cut lines within of the sleeping bag body.

12. The sleeping bag system of claim 11, wherein the one or more straps comprise an elastic material.

13. A method of preventing twisting movement of a sleeping bag during use, the method comprising:

providing a sleeping bag system comprising:

a sleeping bag body including an upper layer and a bottom layer opposite the upper layer, the sleeping bag body including one or more sleeves along a perimeter of the sleeping bag body; and a plurality of poles that interconnect to form a frame;

wherein each sleeve of the one or more sleeves comprises a rectangular sleeve panel including first and second side edges, wherein the first and second side edges are aligned to form a tunnel, wherein the aligned first and second side edges of each sleeve are attached to the sleeping bag body, wherein the sleeping bag body includes one or more cut lines, and wherein each sleeve of the one or more sleeves extends through each cut line of the one or more cut lines within of the sleeping bag body;

positioning the sleeping bag body into a flat position;

positioning each pole of the plurality of poles within a sleeve of the one or more sleeves of the sleeping bag body; and interconnecting the plurality of poles to form the frame.

14. The method of claim 13, wherein the sleeping bag system further comprises connectors configured to connect adjacent poles of the plurality of poles, and wherein the step of interconnecting the plurality of poles includes interconnecting the plurality of poles and connectors to form the frame.

* * * * *